US011332931B2

(12) United States Patent
Markley et al.

(10) Patent No.: US 11,332,931 B2
(45) Date of Patent: May 17, 2022

(54) SPLICE PLATE WITH A CAM LOCK

(71) Applicant: Worthington Armstrong Ventures, Malvern, PA (US)

(72) Inventors: Jeff Markley, Middle River, MD (US); Joshua L. Neal, Phoenixville, PA (US); Yu Lin, Blue Bell, PA (US); Daniel R. Diamondstone, Philadelphia, PA (US)

(73) Assignee: Worthington Armstrong Venture, Malvern, PA (US)

( * ) Notice: Subject to any disclaimer, the term of this patent is extended or adjusted under 35 U.S.C. 154(b) by 0 days.

(21) Appl. No.: 16/831,911

(22) Filed: Mar. 27, 2020

(65) Prior Publication Data

US 2020/0347594 A1 Nov. 5, 2020

Related U.S. Application Data

(60) Provisional application No. 62/828,511, filed on Apr. 3, 2019.

(51) Int. Cl.
*E04B 9/10* (2006.01)
*E04B 9/06* (2006.01)

(52) U.S. Cl.
CPC ..... *E04B 9/10* (2013.01); *E04B 9/064* (2013.01)

(58) Field of Classification Search
CPC ..... E04B 9/10; E04B 9/064
See application file for complete search history.

(56) References Cited

U.S. PATENT DOCUMENTS

| | | | | |
|---|---|---|---|---|
| 3,427,054 | A * | 2/1969 | Bergman | F16B 2/243 403/377 |
| 4,531,340 | A * | 7/1985 | Sauer | E04B 9/10 52/506.07 |
| 5,813,179 | A * | 9/1998 | Koenig, Jr. | E04F 13/06 403/267 |
| 6,199,343 | B1 * | 3/2001 | Sauer | E04B 9/068 403/347 |
| 6,305,139 | B1 * | 10/2001 | Sauer | E04B 9/10 403/346 |
| 7,926,238 | B2 * | 4/2011 | Sareyka | E04B 9/068 52/506.06 |
| 2005/0166509 | A1 * | 8/2005 | Sareyka | E04B 9/125 52/506.07 |
| 2017/0292269 | A1 * | 10/2017 | Tornqvist | E04B 9/064 |

* cited by examiner

*Primary Examiner* — Rodney Mintz
(74) *Attorney, Agent, or Firm* — Stradley Ronon Stevens & Young, LLC

(57) ABSTRACT

A splice plate for joining and aligning extruded trim strips used in suspended ceiling islands and fascias. The splice plate has at least one cam lock connected to a base plate by a fastener. The fastener passes through an aperture in the cam lock and an aperture formed by a projection in the base plate that projects a distance from the face of the base plate. To prevent deformation of the trim strips, the cam lock and base plate may each include bend lines forming an obtuse angle wherein the obtuse angle of the cam lock is less than the obtuse angle of the base plate.

17 Claims, 19 Drawing Sheets

SPLICE PLATE WITH A CAM LOCK

RELATED REFERENCE

This application claims the benefit of priority to U.S. Provisional Patent Application Ser. No. 62/828,511, filed on Apr. 3, 2019, all the contents of which are incorporated in this application by reference.

FIELD OF THE INVENTION

This disclosure relates generally to the field of splice plates and, more specifically, to splice plates for joining and aligning extruded trim strips used in suspended ceiling islands and fascias.

BACKGROUND OF THE DISCLOSURE

In commercial architecture perimeter trim is available in lengths of extruded aluminum with several face height options of, for example, nominally 2, 4, 6, 8, 10, and 12 inches (5.1, 10.2, 15.2, 20.3, 25.4, and 30.5 cms). Typically, the visible face of the trim is flat while its rear face, which is ordinarily concealed in use, has one or more extruded tracks. Conventionally, the shorter (narrower) strips have a single track on their rear face as a part of the extruded cross-section. These tracks are formed by two opposed grooves, and are used for attaching the trim to a suspended grid and for receiving splice plates for joining the ends of the trim. The track receives clips for connecting the trim strip to a suspended ceiling grid and for receiving splice plates. Taller trim strips can have multiple tracks.

Typically, a splice plate is assembled in the tracks at the ends of two trim pieces to be joined so that the plate bridges the joint. The splice plate locks the abutting trim pieces together and aligns the visible faces of the abutting trim pieces, both vertically and horizontally. In the case of corners, the splice plate keeps the trim in a tight vertically registered joint.

Some prior art splice plates use set screws to secure the splice plate to the trim strips. Such set screws push directly against the vertical main wall of the trim strip that forms the appearance face. The drawback of such a configuration is that the holding force the screw imparts on the main beam is limited by how much force the vertical wall can be subjected to without deforming. Such distortion, causes the appearance face to be permanently bowed or blemished, and can cause abutting trim misalignment. As a result, it is difficult for an installer to obtain the desired holding force using splice plates with set screws. To overcome this limitation such prior art splice plates simply add additional set screws. Such additions increase the size of the splice plates. However, the increase in the area of the splice plates has its own drawbacks. For example, the added area taken up by the splice plate cannot be used by other accessory clips. In summary, the use of splice plates with set screws is not the answer. Such splice plates either crowd out other accessory plates, lack the desired holding power, or when obtaining the desired holding power there is a risk that the trim strip face will be distorted if the set screw is over-tightened. Such distortion, causes the appearance face to be permanently bowed or blemished, and can cause abutting trim misalignment.

Some prior art splice plates are also bulky and interfere with the installation and removal of acoustical tile in a ceiling construction. Where screws are used in the splice plate, a power driver carried by an installer can limit the speed of the process by requiring the installer to separately handle the driver and screw while aligning each screw with the splice plate. Such an installation method is problematic because the installer cannot readily tighten or hold a joint tight when holding both the screw and the power driver.

Therefore, there exists a need for a splice plate with additional holding strength that locks the abutting trim pieces together and aligns the visible faces of the abutting trim pieces, both vertically and horizontally, with fasteners that are part of the splice plate and do not deform the faces of the abutting trim pieces.

BRIEF SUMMARY OF THE DISCLOSURE

The splice plate disclosed below provides the desired additional holding strength during the construction process which eliminates the possibility of trim separation that cannot be attained with prior designs without the risk of face distortion. To meet this and other needs, and in view of its purposes, a splice plate that includes at least one cam lock is provided. In one embodiment, this splice plate comprises a base plate made of a sheet of material having a first side and a second side defining a height and a first thickness. The base plate includes a projection defining a first aperture and projecting a distance from the base plate in a direction substantially perpendicular to the plane of the base plate. The projection includes an inner surface configured to engage a fastener. The splice plate also includes a cam lock made of a sheet of material that is bent, has a first side and a second side defining a height, and has a second thickness. The cam lock includes a second aperture through which a fastener may pass to connect the base plate and the cam lock.

In certain embodiments, to prevent the fastener from contacting the trim strip and potentially deforming the trim face, the fastening element of the fastener (e.g., the threads of a screw) has a height that is less than or equal to the sum of the first thickness, the second thickness, and the distance. Indeed, this disclosed design increases construction efficiency by taking onus off the contractor to avoid face distortion and may eliminate rework in the case of trim separation.

In certain embodiments, to prevent the fastener from contacting the trim strip and potentially deforming the trim face, both the cam lock and the base plate include two bend lines. The base plate bend lines form a first obtuse angle. The cam lock bend lines for a second obtuse angle. Inc certain embodiments, the first obtuse angle is greater than the second obtuse angle. By way of example, the first angle may be greater than 120 degrees whereas the second angle may be 120 degrees or less. Furthermore, in such configurations, the fastening element of the fastener (e.g., the threads of a screw) may have a height that is greater than the sum of the first thickness, the second thickness, and the distance.

To potentially assist with locking the trim pieces together, the first side or second side of either the base plate or the cam plate may be tapered, sharp, or serrated. Furthermore, the cam lock or base plate material may be harder than aluminum.

In another embodiment, the splice plate has two or more projections and two or more cam locks. Such projections and cam locks each may be spaced an equal-opposite distance from the center of the splice plate.

In a further embodiment, the splice plate further includes a flange extending out from an edge of the base plate in the direction of the projection. The flange may be farther from the center of the width than the cam lock.

In one embodiment, the base plate further comprises a protuberance projecting in a direction substantially perpendicular to the plane of the base plate. The protuberance may be closer to the center of the width than the cam lock. The protuberance may be shaped like a triangle, square, cylinder, circle, oval, or rectangle. Furthermore, there may be two or more protuberances.

In another embodiment, the base plate has weak points which may reduce the force required to bend the base plate. There may be two or more weak points, which may be aligned along the height of the base plate. Furthermore, the weak points may take the form of an aperture, notch, or cutout.

In a further embodiment, flanges extend out from an edge of the cam lock in the direction opposite the bend. Indeed, the cam lock has a first edge and a second edge that define a width, and flanges may extend out from one or both of the first edge and second edge.

In one embodiment, when the bend is removed from the cam lock the height of the cam lock is between about 85% and about 95% of the height of the base plate.

In another embodiment, the fastener is a screw having a head shape that may be full-bearing, washer-faced, double chamfered, square, slotted-hexagon, countersunk, raised-countersunk, round, pan, cheese, raised-cheese (fillister), mushroom (truss), hi-torque, phillips countersunk, phillips raised countersunk, phillips round-pan, phillips round, countersunk hexagon socket, button hexagon socket, flat or cap hexagon socket, or knurled.

It is to be understood that both the foregoing general description and the following detailed description are exemplary, but are not restrictive, of the invention.

BRIEF SUMMARY OF THE SEVERAL VIEWS OF THE DRAWING

The invention is best understood from the following detailed description when read in connection with the accompanying drawing and appended claims. It is emphasized that, according to common practice, the various features of the drawing are not to scale. On the contrary, the dimensions of the various features are arbitrarily expanded or reduced for clarity. Included in the drawing are the following figures:

DETAILED DESCRIPTION

Figure 1A:
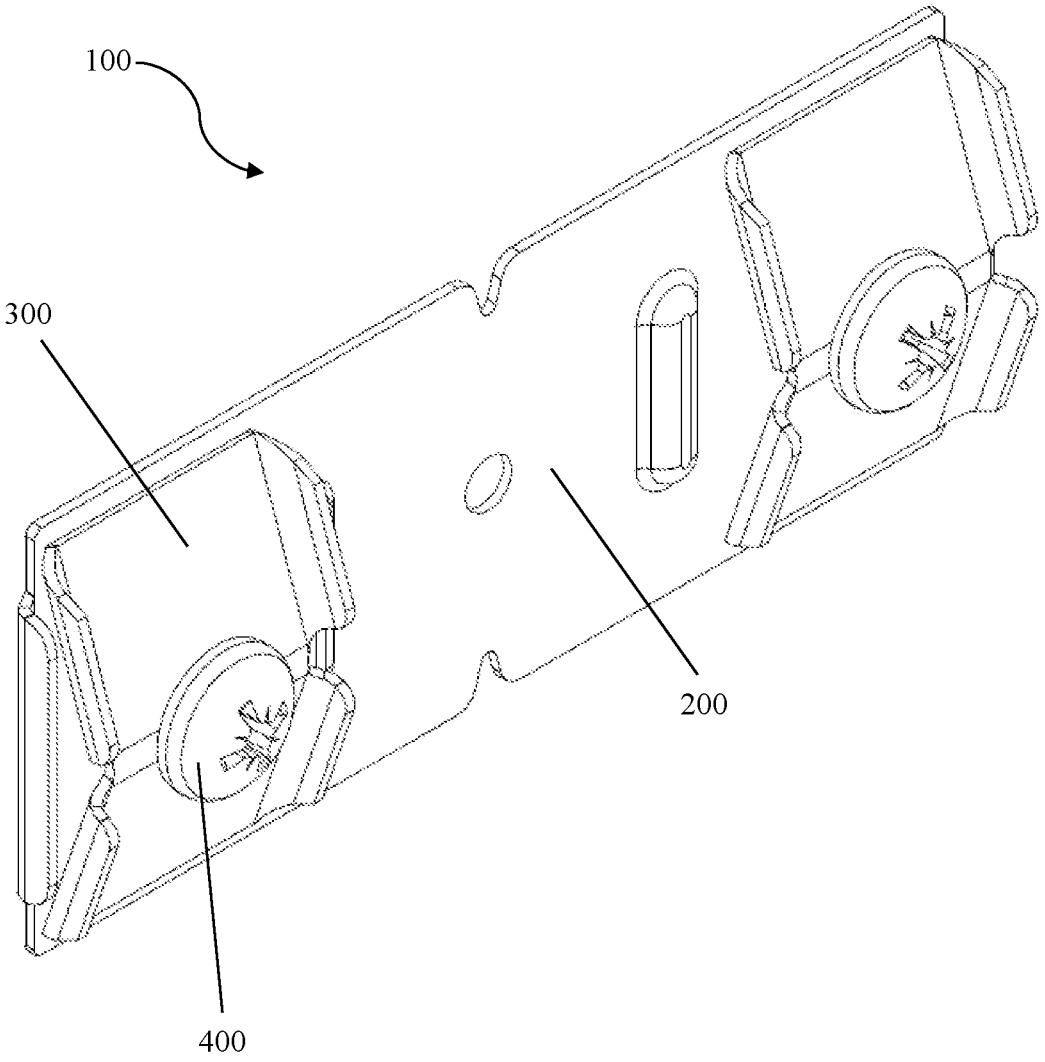
FIG. 1A is a perspective view of one embodiment of the splice plate.

The features and benefits of the disclosed splice plate 100 are illustrated and described by reference to exemplary embodiments. The disclosure also includes the drawing, in which like reference numbers refer to like elements throughout the various figures that comprise the drawing. This description of exemplary embodiments is intended to be read in connection with the accompanying drawing, which is to be considered part of the entire written description. Accordingly, the disclosure expressly should not be limited to such exemplary embodiments illustrating some possible non-limiting combination of features that may exist alone or in other combinations of features.

In the description of embodiments, any reference to direction or orientation is merely intended for convenience of description and is not intended in any way to limit the scope of the present invention. Relative terms such as "lower," "upper," "horizontal," "vertical," "above," "below," "up," "down," "top," and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be construed or operated in a particular orientation. Terms such as "attached," "affixed," "connected," "coupled," "interconnected," and similar terms refer to a relationship wherein structures are secured or attached to one another either directly or indirectly through intervening structures, as well as both moveable or rigid attachments or relationships, unless expressly described otherwise.

A fastener 400 of the splice plate 100, bears down on a cam lock 300, which flattens the cam lock 300 such that it engage with the tracks of the trim thereby permitting the installer to secure the trim pieces without the fastener 400 deforming the trim. In one embodiment, the fastener 400 does not contact the face of the trim. In contrast, known splice plates push directly against the vertical main wall of the trim strip, or require an installer to handle three, separate components (i.e., trim, driver, and fastener) at one time. As a result, such known splice plates may deform the trim or be difficult to install by a single individual who only has two hands to accommodate the three, separate components. Conversely, the disclosed splice plate 100 may engage and/or secure trim without deforming its face and may also be installed by a single installer.

Splice Plate Structure

Figure 1B:
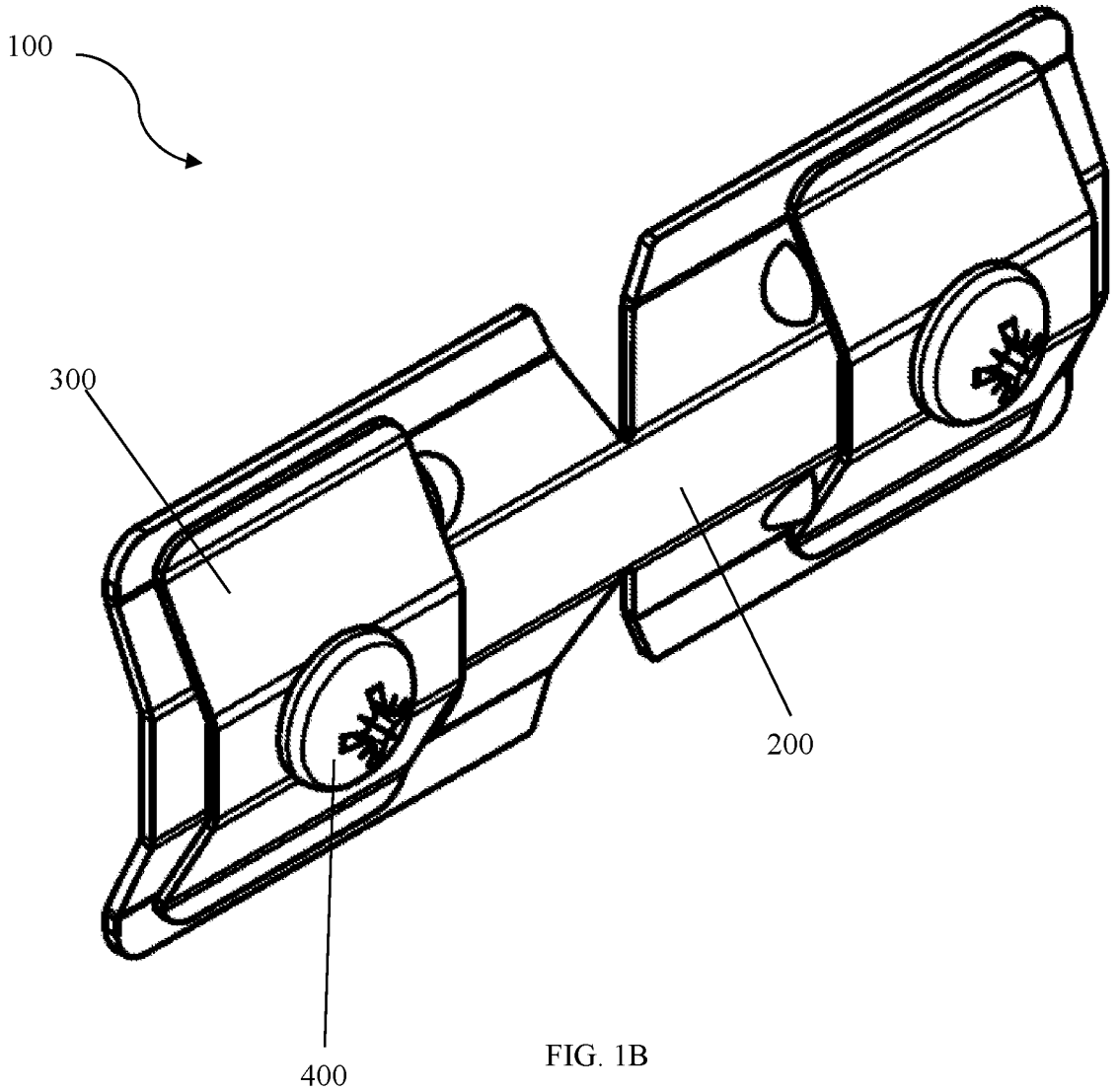
FIG. 1B is a perspective view of one embodiment of the splice plate.
Figure 2A:
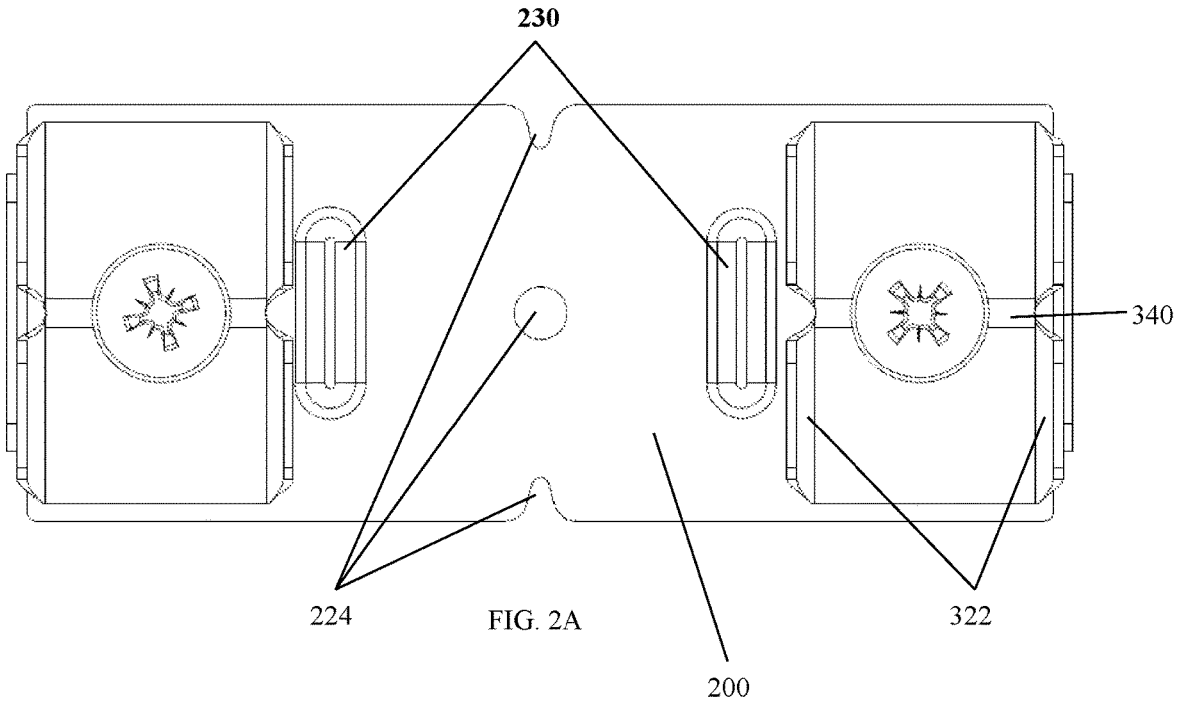
FIG. 2A is a top view of the splice plate of FIG. 1A.
Figure 2B:
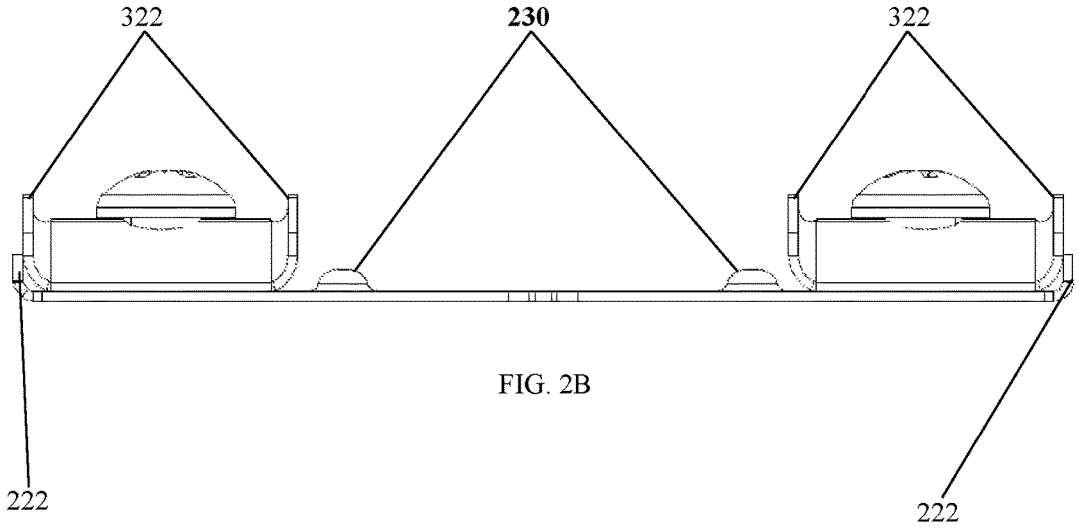
FIG. 2B is a side view of the splice plate of FIG. 1A.
Figure 2C:
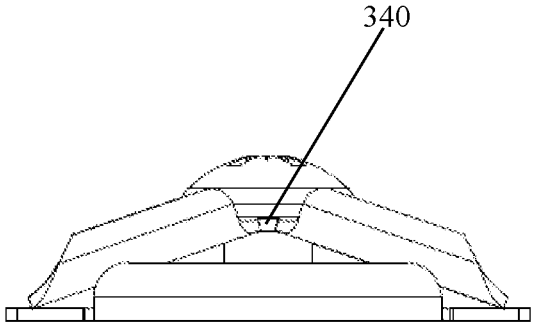
FIG. 2C is a front view of the splice plate of FIG. 1A.
Figure 2D:
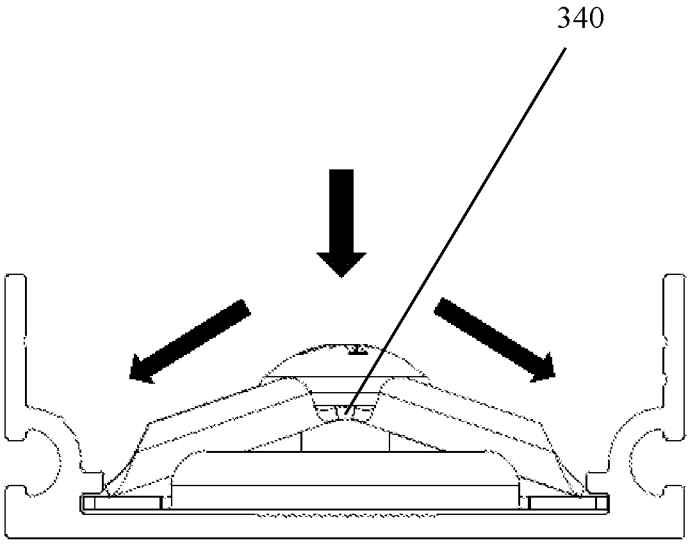
FIG. 2D is a front section view of FIG. 1A depicting how the force applied to the top of the cam lock by the fastener is transmitted by the cam lock.
Figure 2E:
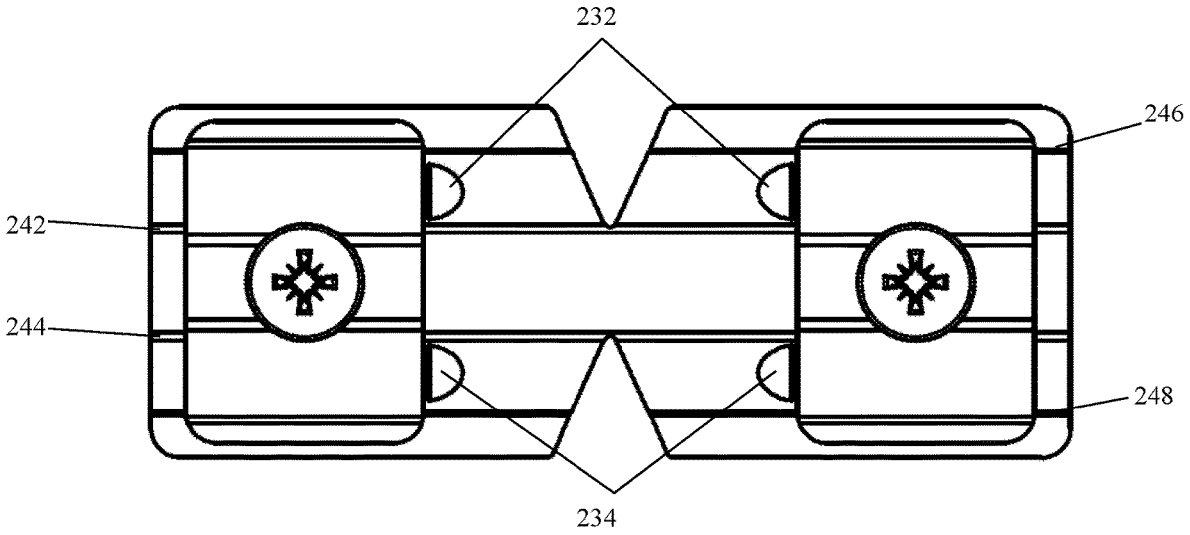
FIG. 2E is a top view of the splice plate of FIG. 1B.
Figure 2F:
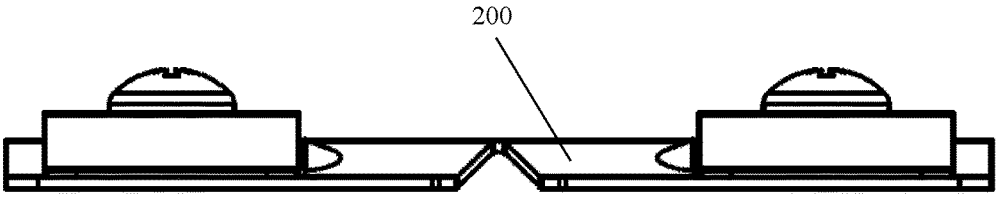
FIG. 2F is a side view of the splice plate of FIG. 1B.
Figure 2G:
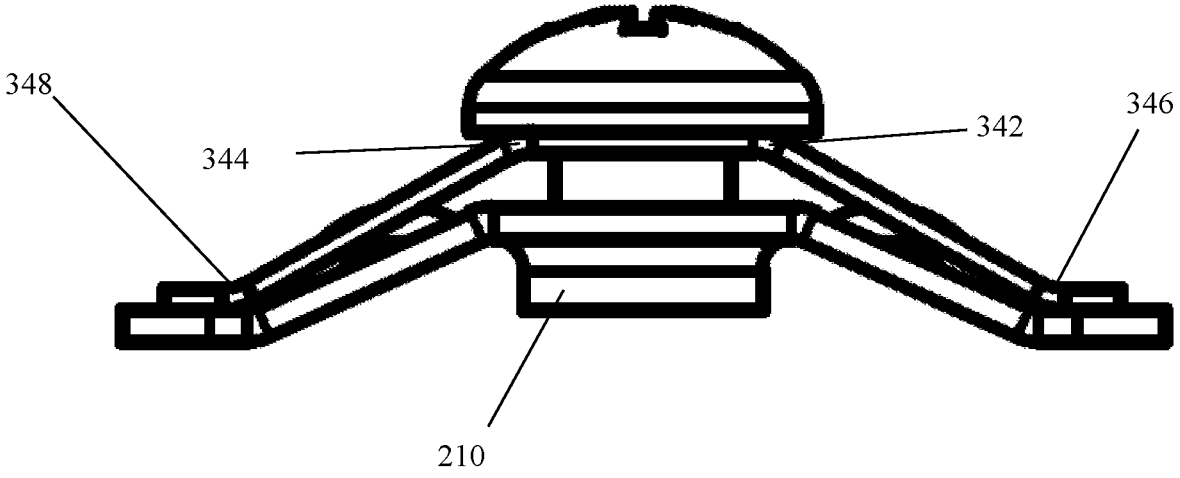
FIG. 2G is a front view of the splice plate of FIG. 1B.
Figure 2H:
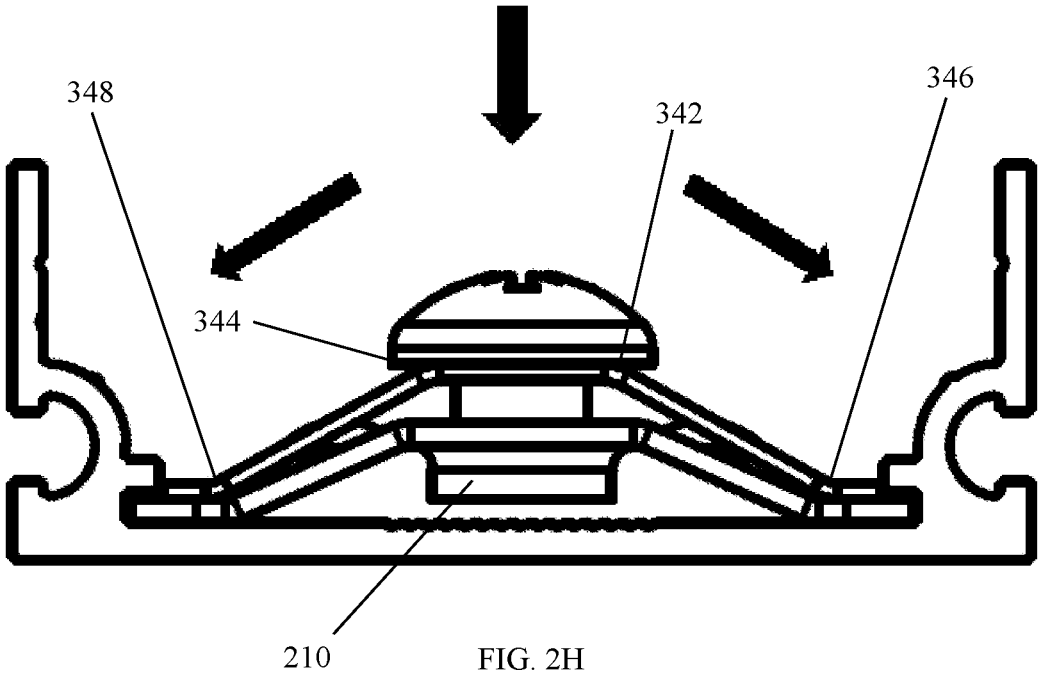
FIG. 2H is a front section view of FIG. 1B depicting how the force applied to the top of the cam lock by the fastener is transmitted by the cam lock.
Figure 2I:
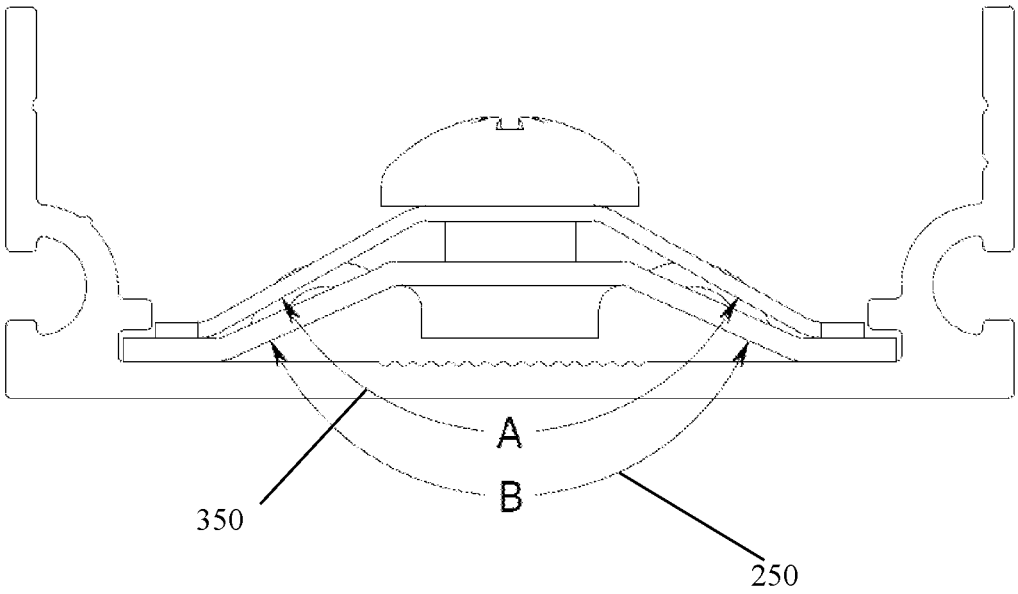
FIG. 2I is a front section view of FIG. 1B depicting one embodiment of the first and second obtuse angles of the base plate and cam lock.
Figure 3A:
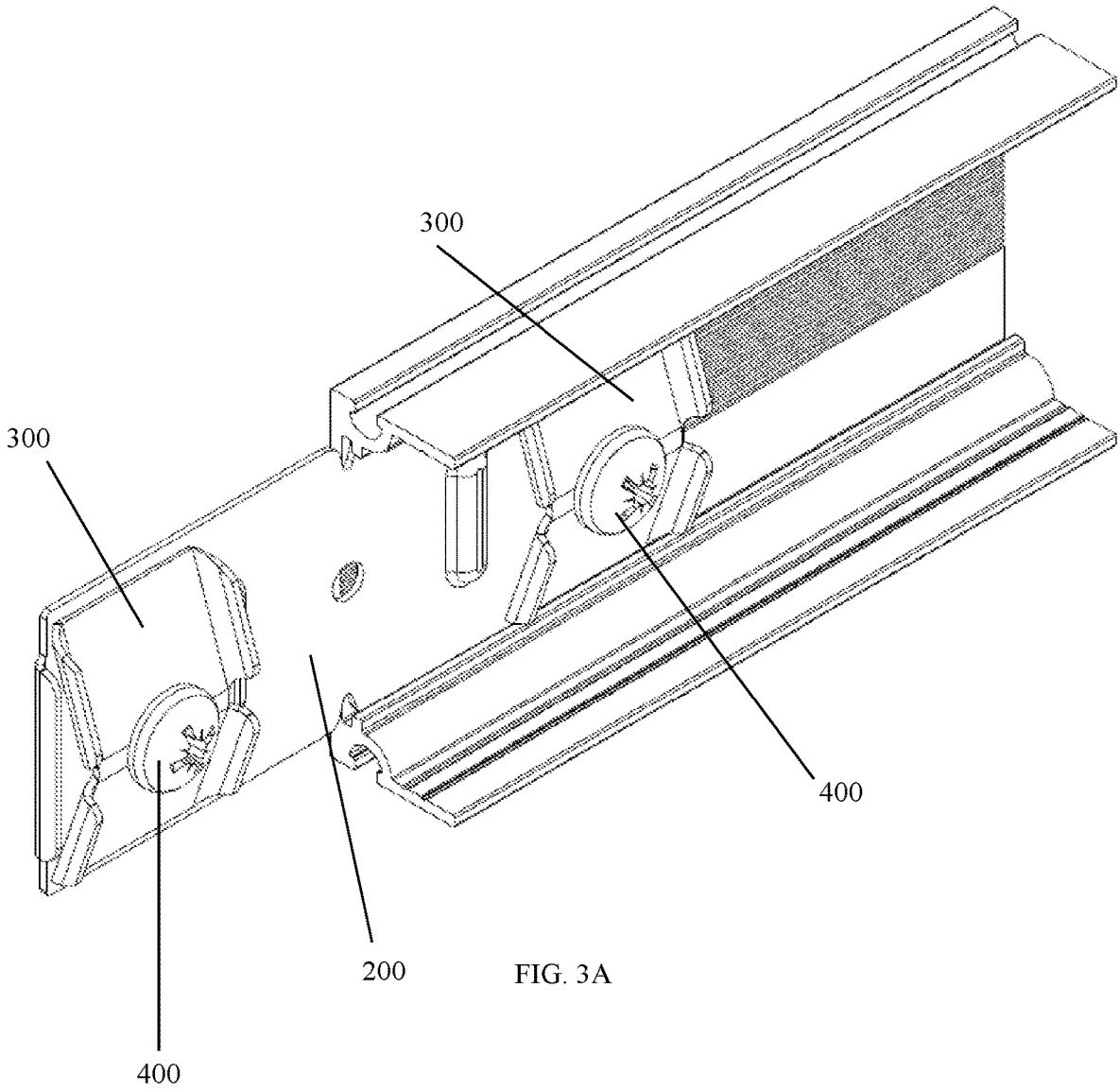
FIG. 3A is an embodiment of a trim piece engaged with the splice plate of FIG. 1A.
Figure 3B:
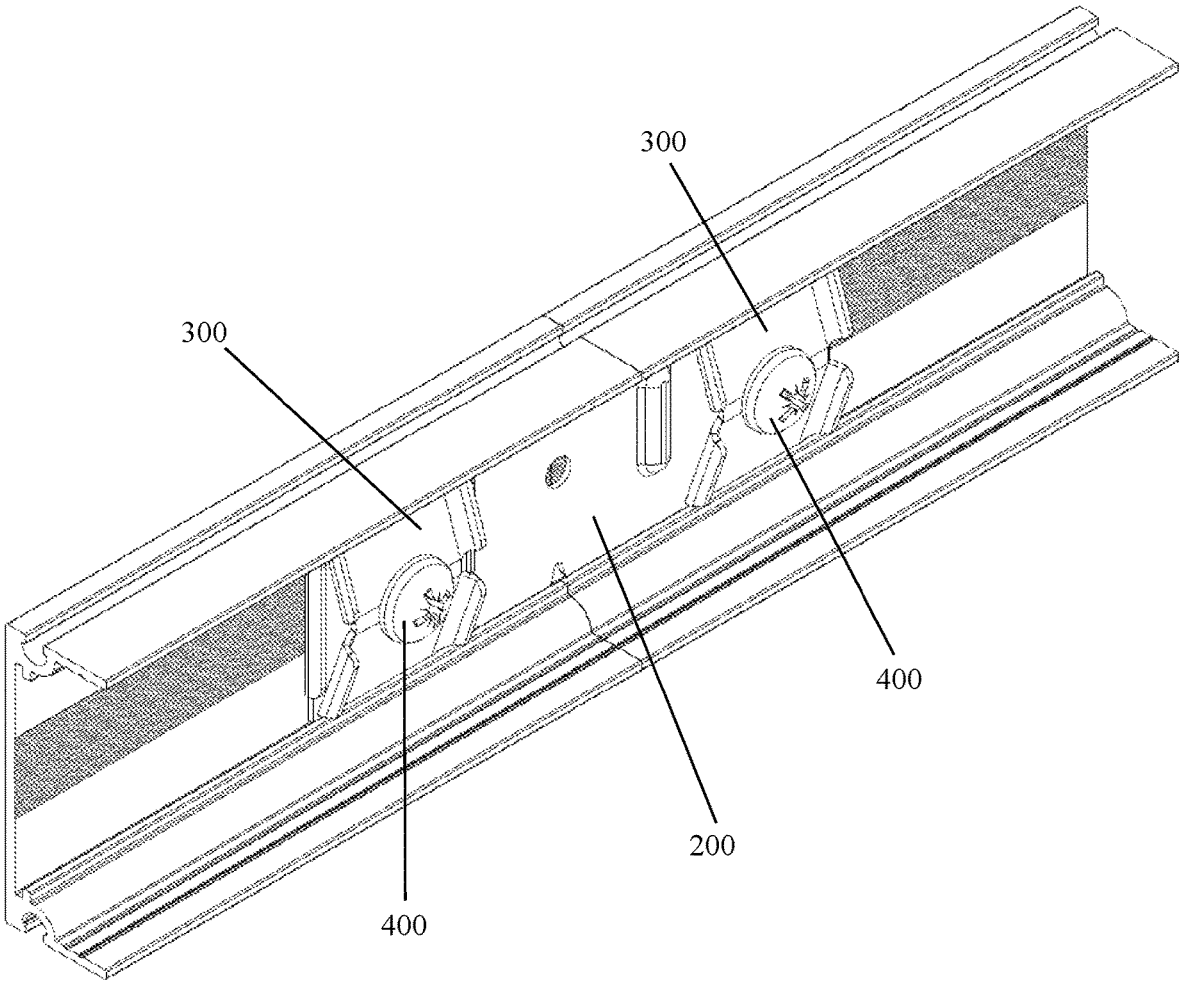
FIG. 3B is an embodiment of two trim pieces engaged with the splice plate of FIG. 1A.
Figure 3C:
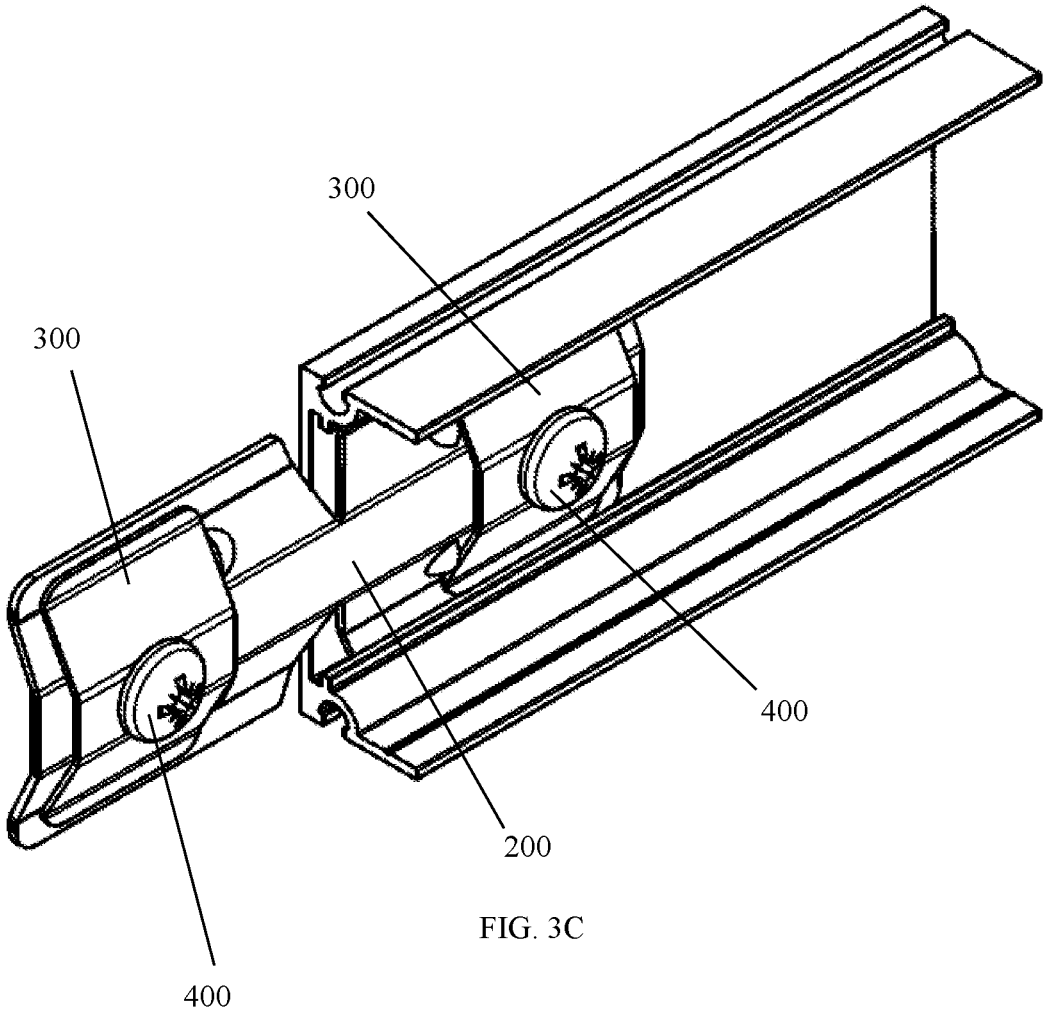
FIG. 3C is an embodiment of a trim piece engaged with the splice plate of FIG. 1B.
Figure 3D:
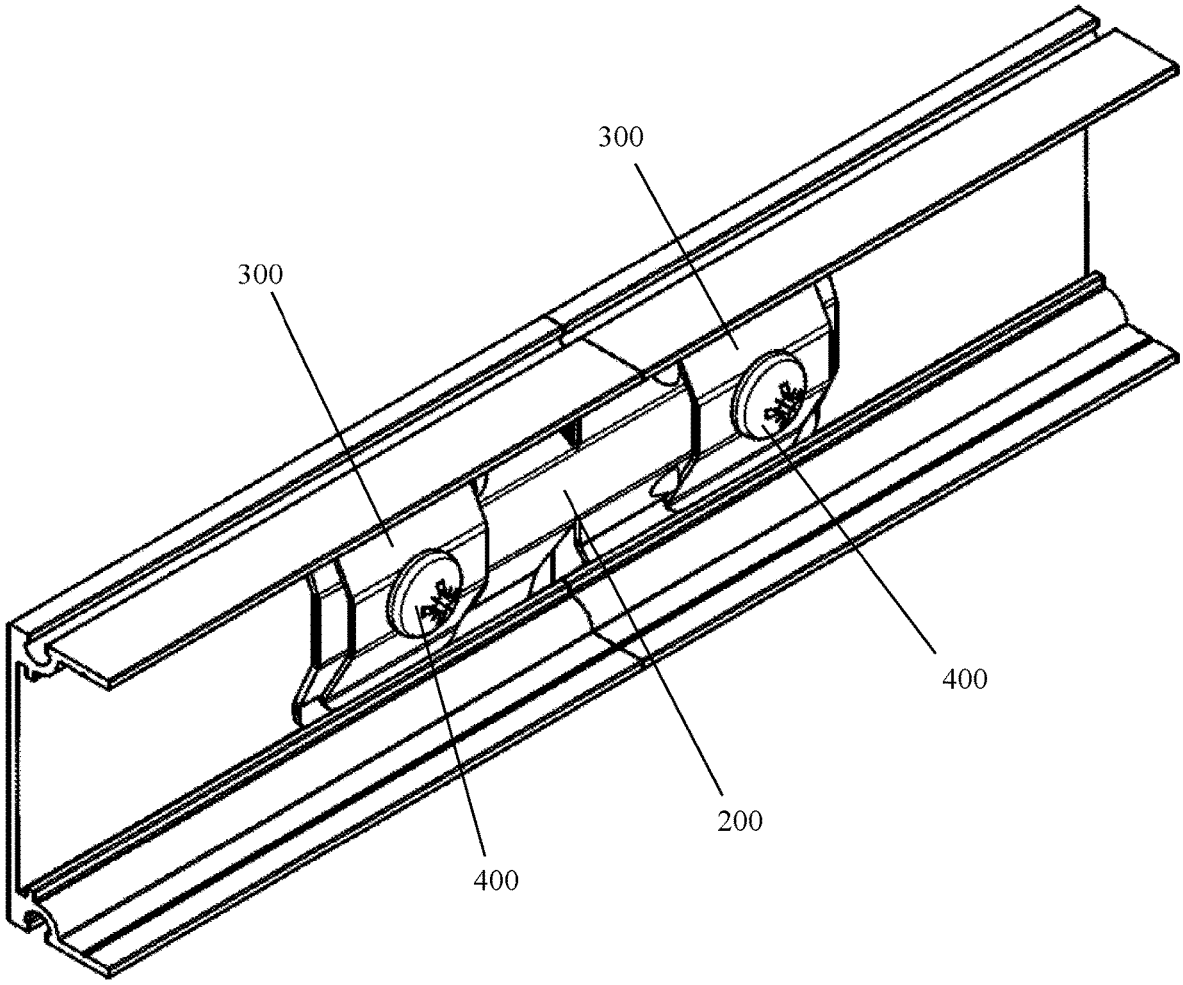
FIG. 3D is an embodiment of two trim pieces engaged with the splice plate of FIG. 1B.
Figure 4A:
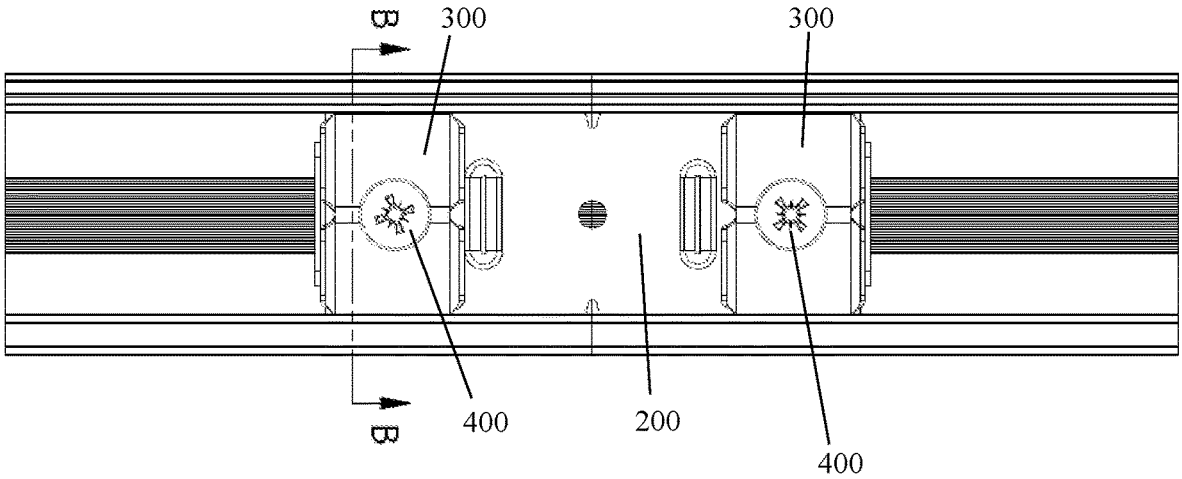
FIG. 4A is a top view of the two trim pieces engaged with the splice plate of FIG. 1A.
Figure 4B:
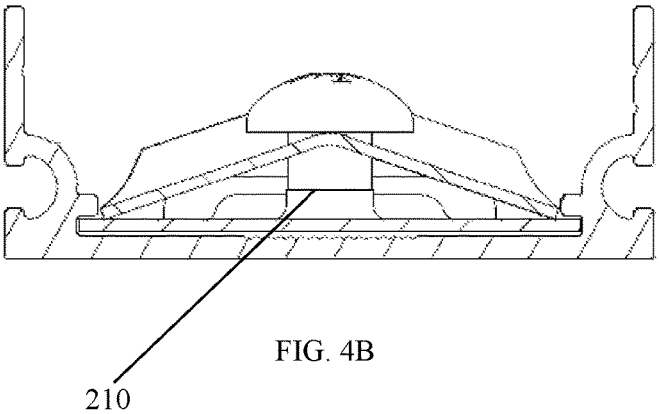
FIG. 4B is a front sectional view taken on the line B-B of FIG. 4A.
Figure 4C:
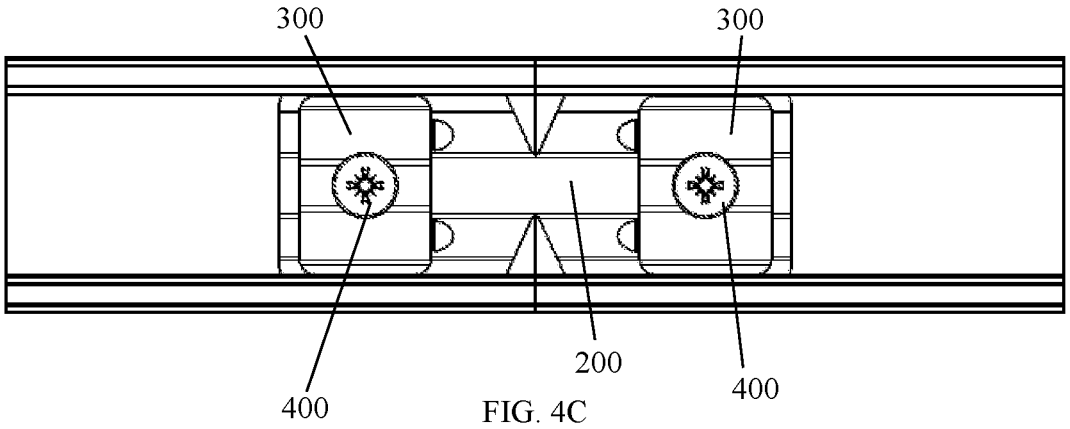
FIG. 4C is a top view of the two trim pieces engaged with the splice plate of FIG. 1B.
Figure 4D:
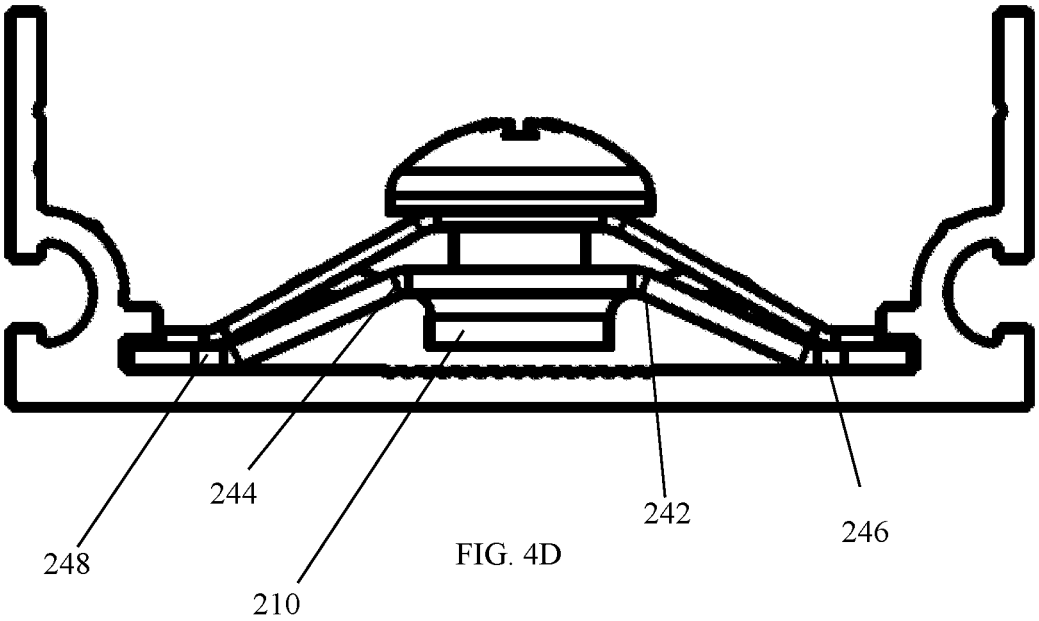
FIG. 4D is a front section view of the splice plate of FIG. 1B.

FIG. 1 depicts an exemplary embodiment of the splice plate 100 according to the present disclosure. The splice plate 100 includes a base plate 200 and the cam lock 300 connected by the fastener 400.

The base plate 200 has a length and a height, and includes at least one projection 210, defining a first aperture 212 and projecting a distance from the base plate 200 in a direction substantially perpendicular to the plane of the base plate 200. The projection 210 is substantially centered with regard to the height of the base plate 200, and may also be configured to engage the fastener 400 (e.g., it may be threaded).

The cam lock 300 has a length and a height, and includes a second aperture that is substantially centered with regard to the height of the cam lock 300. Prior to engagement with the trim piece the cam lock 300 is not substantially planar. Indeed, the cam lock 300 may be bent along a line that may pass through the second aperture.

Base Plate

Figure 5A:
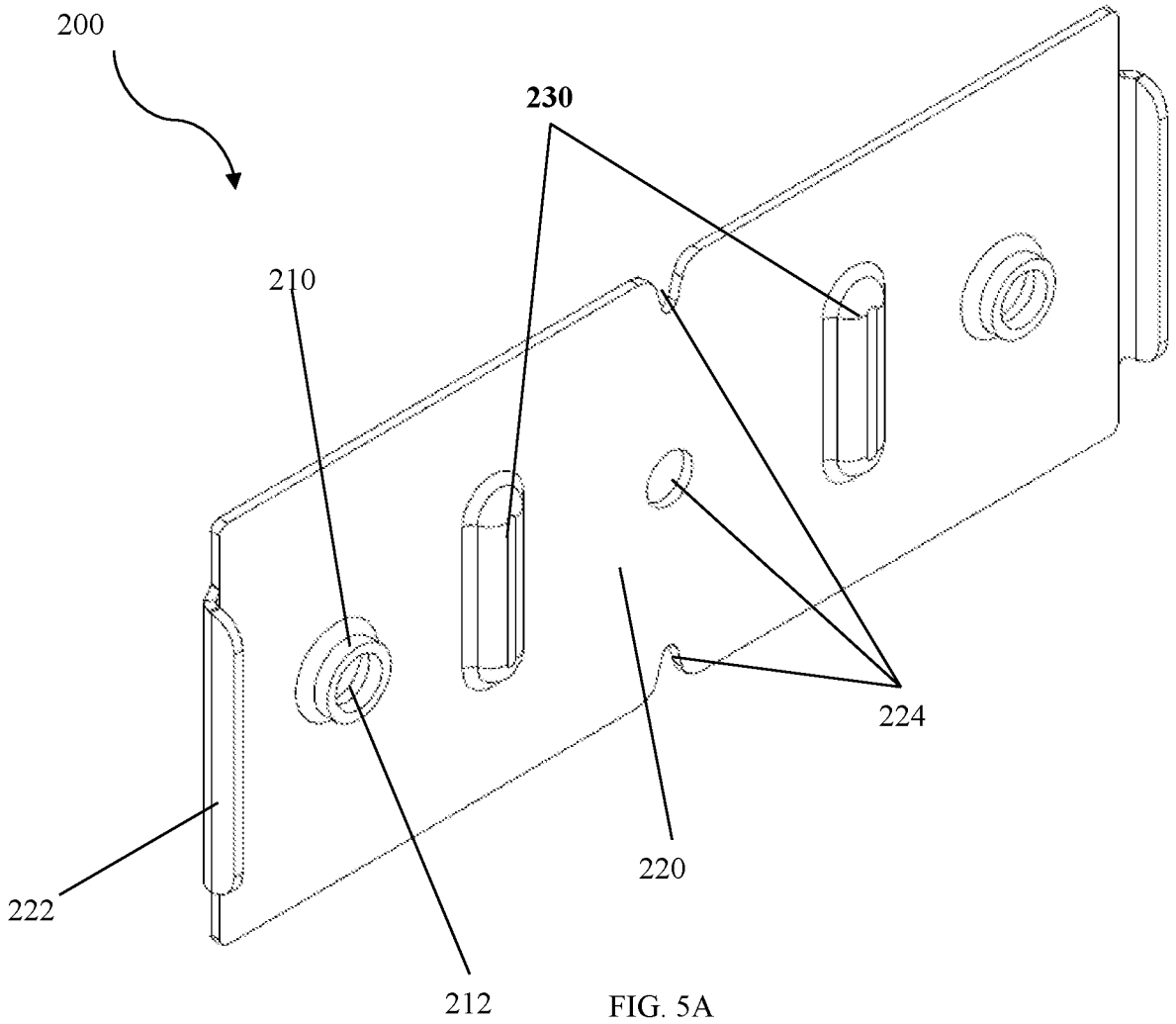
FIG. 5A is a perspective view of one embodiment of a base plate.
Figure 5B:
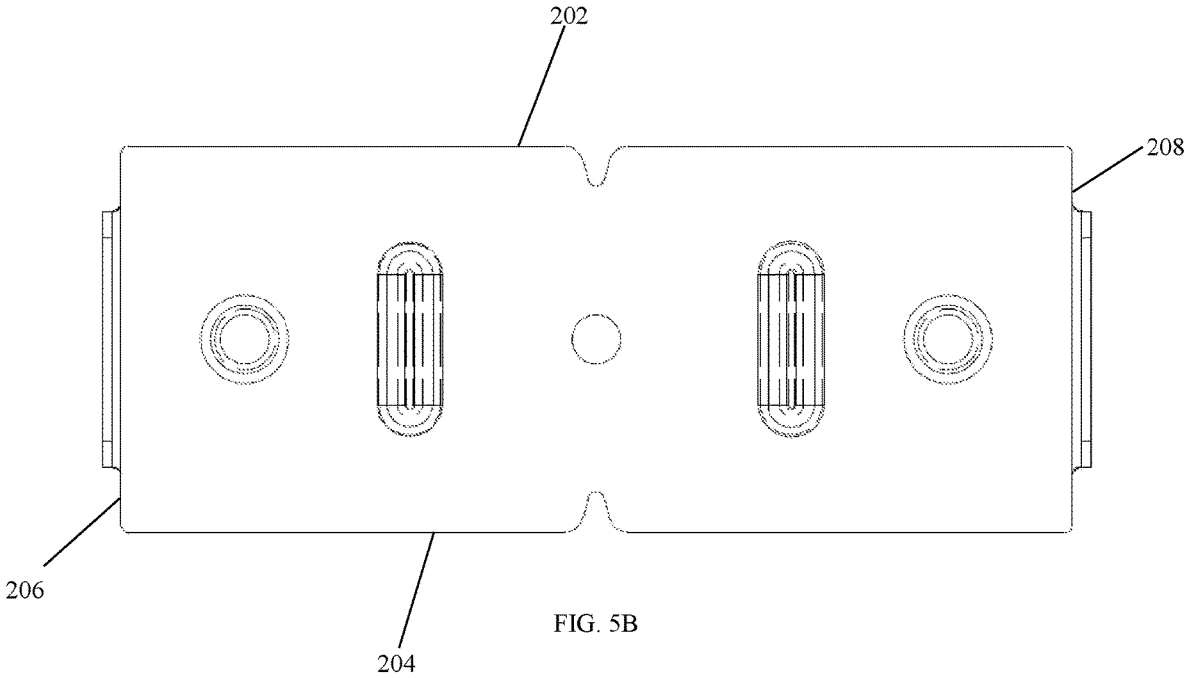
FIG. 5B is a top view of the base plate of FIG. 5A.
Figure 5C:
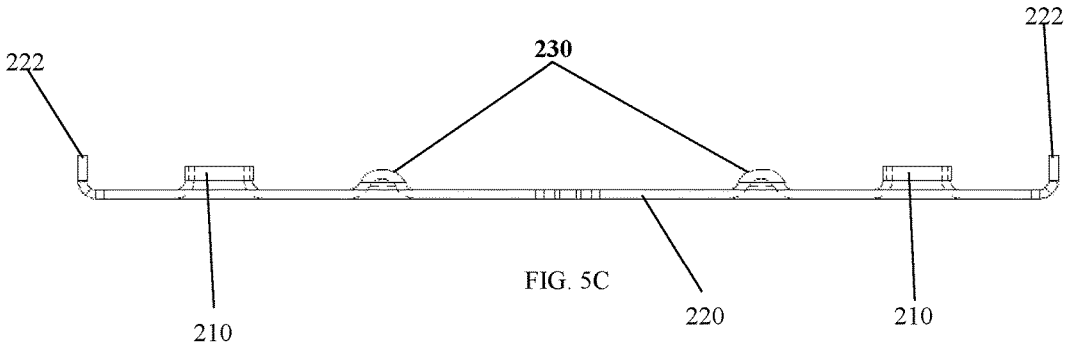
FIG. 5C is a side view of the base plate of FIG. 5A.
Figure 5D:
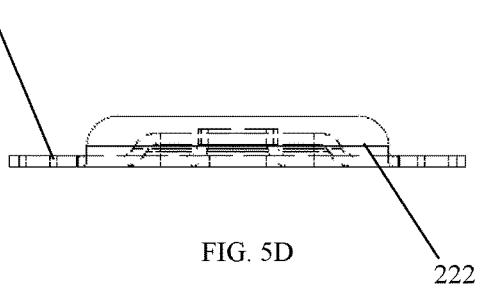
FIG. 5D is a front view of the base plate of FIG. 5A.
Figure 5E:
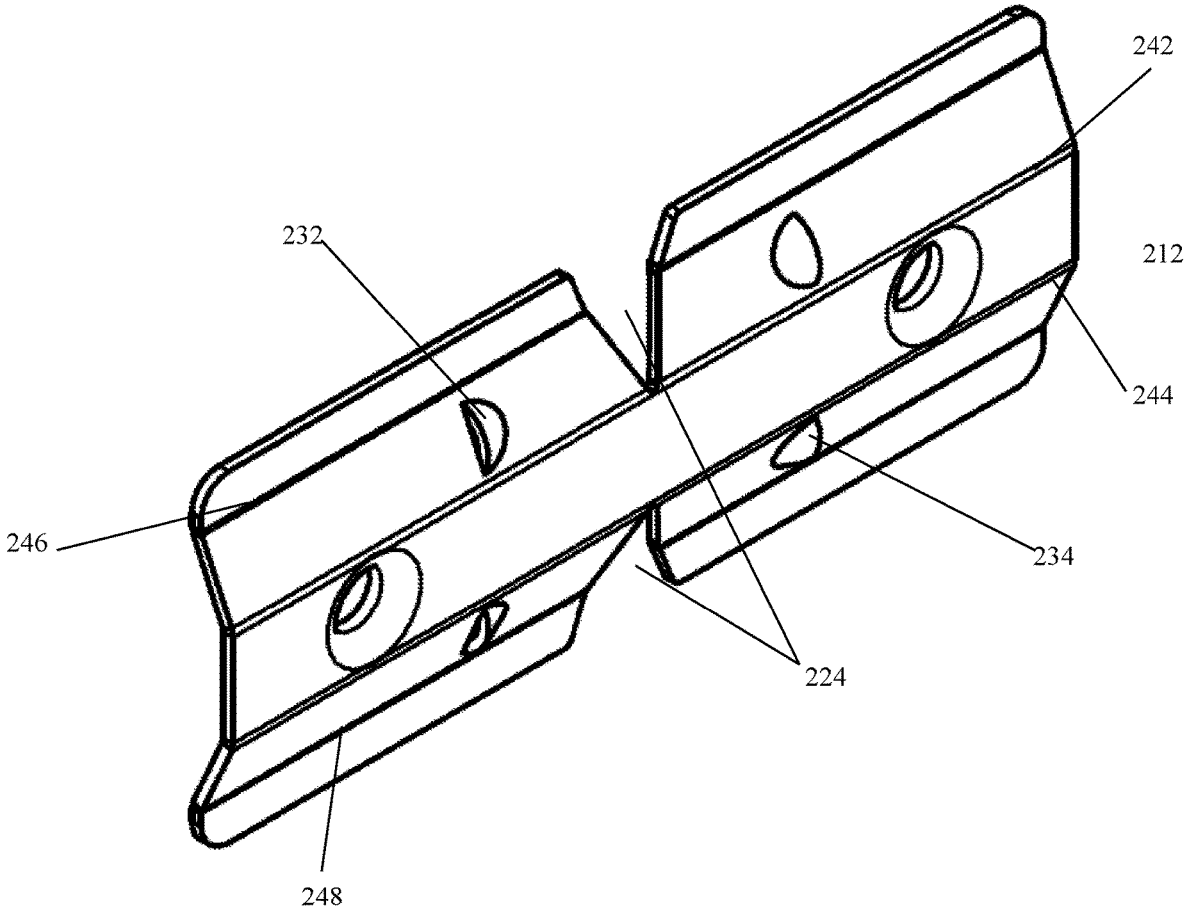
FIG. 5E is a perspective view of one embodiment of a base plate.
Figure 5F:
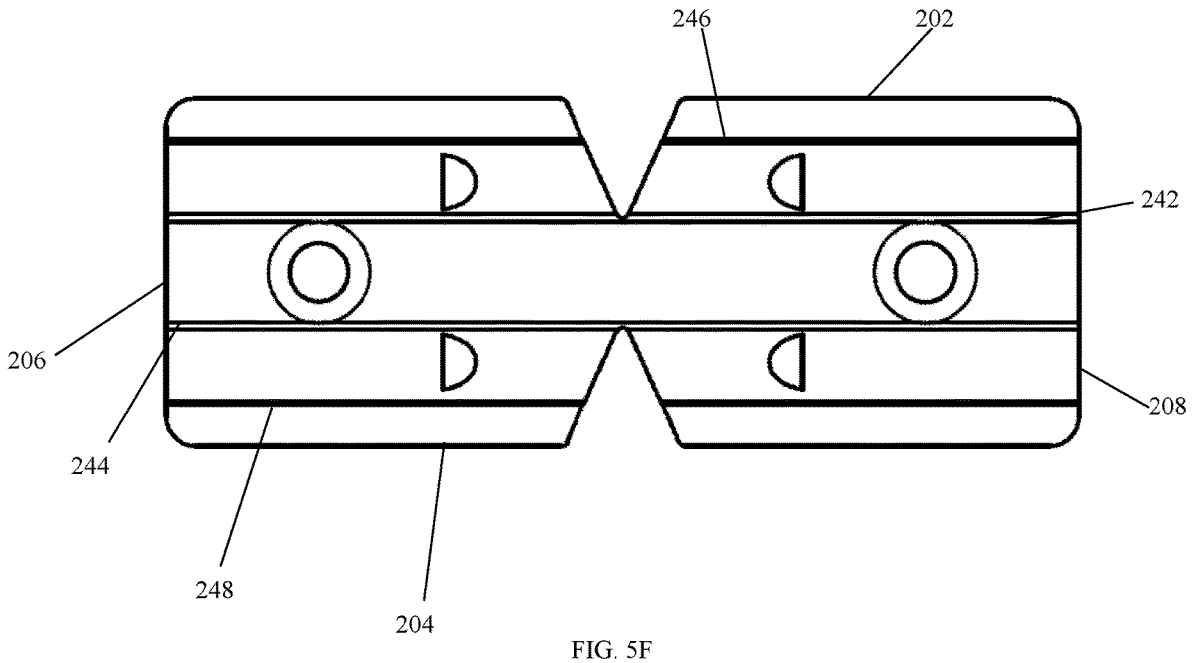
FIG. 5F is a top view of the base plate of FIG. 5E.
Figure 5G:
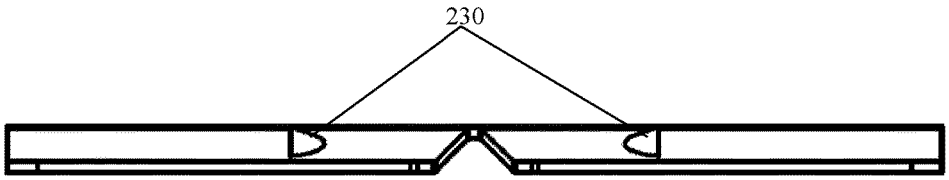
FIG. 5G is a side view of the base plate of FIG. 5E
Figure 5H:
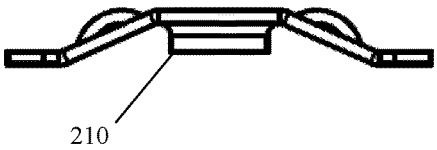
FIG. 5H is a front view of the base plate of FIG. 5E

FIG. 5A depicts an exemplary embodiment of the base plate 200 according to the present disclosure. The base plate 200 may be constructed of a single sheet of material having a height and a width. The height may be measured from a first side 202 to a second side 204, which may be substantially parallel to the first side 202. The width may be measured from a first edge 206 to a second edge 208, which may be substantially parallel to the second edge 208.

In one embodiment, the base plate 200 includes the projection 210, defining a first aperture 212 and projecting a distance from the base plate 200 in a direction substantially perpendicular to the plane of the base plate 200. In certain embodiments, the first aperture 212 projects out from the base plate 200 in a direction substantially perpendicular to the plane of the base plate 200 a distance of about 1/16" to about 3/16". In other embodiments, the first aperture 212 projects out from the base plate 200 in a direction substantially perpendicular to the plane of the base plate 200 a distance of about 0.1". The projection 210 may take a triangle, square, cylinder, circular, oval, or rectangle shape. In one embodiment, the projection 210 is substantially centered with regard to the height of the base plate 200. In another embodiment, the projection 210 is closer to the first side 202 than the second side 204. Conversely, the projection 210 may be closer to the second side 204 than the first side 202. The interior surface of the projection 210 may be adapted to engage the fastener 400. For example, the interior surface of the projection 210 may be threaded.

In another embodiment, the base plate 200 includes two or more projections 210, each defining an aperture 212 and projecting a distance from the base plate 200 in a direction substantially perpendicular to the plane of the base plate 200. In one embodiment, one projection 210 is located a distance from the first side 202 about equal to the distance as a second projection 210 is from the second side 204. In another embodiment, one projection 210 may be closer to the first side 202 than the second projection is to the second side 204. In another embodiment, one projection 210 may be farther from the first side 202 than the second projection is from the second side 204.

In a further embodiment, the base plate 200 is substantially planar (e.g., flat). In another embodiment, the base plate 200 may be bowed or curved. Such a curve may proceed along the width, the height, or a combination thereof, for example along the diagonal line that runs between the intersection of the first side 202 and the first edge 206 to the intersection of the second side 204 with the second edge 208. Such curvatures may assist the baseplate 200 in engaging with the extruded tracks of the trim pieces.

In certain embodiments, the first aperture 212 projects out from the curve of the base plate 200. In other embodiments, the first aperture 212 projects into the curve of the base plate 200.

In certain embodiments the base plate 200 includes a bend line 242 running substantially parallel to the first side 202 and/or the second side 204. In other embodiments, the base plate 200 includes two or more bend lines 242, 244. In such embodiments, a first bend line 242 may be about the same distance from the first side 202 that a second bend line 244 is from the second side 204. In other embodiments, the base plate 200 includes four or more bend lines 242, 244, 246, 248. In such embodiments, a third bend line 246 may be about the same distance from the first side 202 that a fourth bend line 248 is from the second side 204. In certain embodiments, the base plate 200 is bent in different directions at the first and second bend lines 242 and 244 than it is at the third and fourth bend lines 246 and 248, which may define a chicane.

In one embodiment, the base plate 200 is comprised of a body 220 with a flange 222 extending out from the body 220. In one embodiment, the flange 222 may project from any of the first side 202, second side 204, first edge 206, or second edge 208. The flange 222 may also project in a direction substantially perpendicular to the plane of the body 220. Conversely, the flange 222 may be adapted to engage with the extruded tracks of the trim pieces. For example, in such an embodiment, the body 220 of the base plate 200 may be curved or bowed with flanges 222 that extend out at an angle from the body 220.

In another embodiment any of the first side 202, second side 204, first edge 206, or second edge 208 may be tapered, sharp, or serrated. In another embodiment, the flanges 222 may be tapered, sharp, or serrated. In a further embodiment, the flanges 222 may be curved. The flanges 222 may also be adapted to prevent the rotation of the cam lock 300 or clip bowing while tightening the fastener 400.

In a further embodiment, the base plate 200 may include a protuberance 230, projecting out from the plane of the base plate 200 in the direction of the projection 210. Such a protuberance 230 may take a triangle, square, cylinder, circular, semi-circular, oval, or rectangle shape. In one embodiment, the protuberance 230 is substantially centered with regard to the height of the base plate 200. In another embodiment, the protuberance 230 is closer to the first side 202 than the second side 204. Conversely, the protuberance 230 may be closer to the second side 204 than the first side 202. In another embodiment, the protuberance 230 is closer to the center of the width of the base plate 200 than the cam lock 300. Such a protuberance 230 may reduce clip bowing, or prevent rotation of the cam lock 300 while tightening the fastener 400.

In one embodiment, the base plate includes two or more protuberances 230. In such embodiments, a first protuberance 232 may be about the same distance from the first side 202 that a second protuberance 234 is from the second side 204. In certain embodiments, the protuberances the first and second protuberances 232 and 234 are substantially the same distance from the first edge 206. In other embodiments, the protuberances 230 are located between either the first and third bend line 242 and 246 or the second and fourth bend lines 244 and 248.

In one embodiment, the base plate 200 may include an intentional weak point 224. Such weak points 224 may take the form of a notch, cutout, or hole. Such weak points 224 may be linearly aligned along the height of the base plate 200. The weak points 224 may be adapted to ease the force required to bend the base plate 200 for applications such as corner installations.

In another embodiment, the base plate 200 may take a triangle, square, cylinder, circular, oval, or rectangle shape.

In a further embodiment, the base plate 200 may be constructed of metal that is harder than aluminum. In certain embodiments, the base plate 200 may have a thickness of about 0.025" to about 0.060".

Cam Lock

Figure 6A:
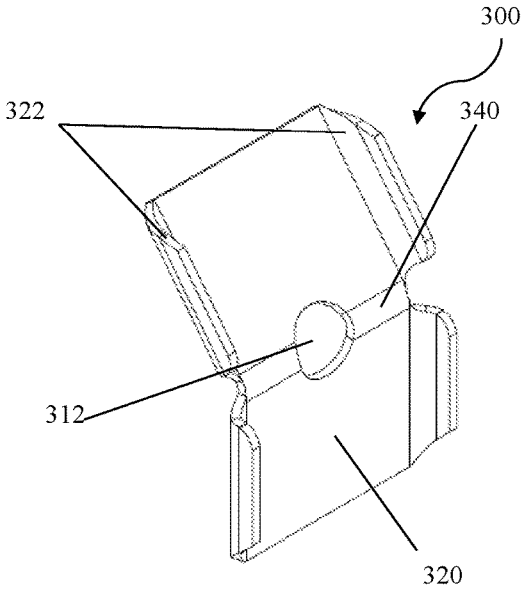
FIG. 6A is a perspective view of one embodiment of a cam lock.
Figure 6B:
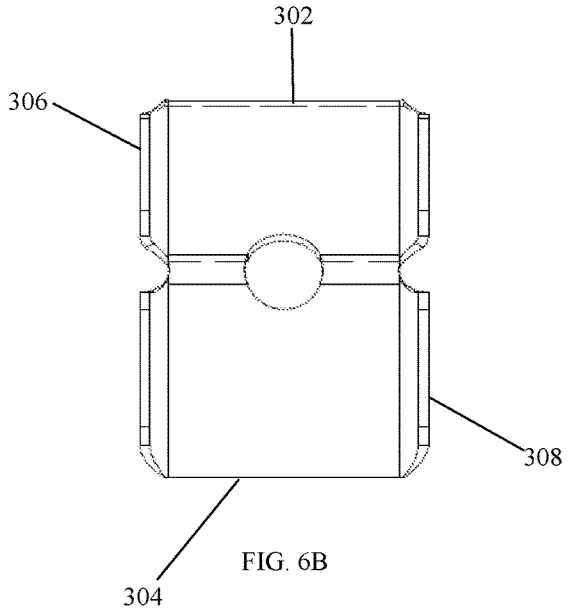
FIG. 6B is a top view of the cam lock of FIG. 6A.
Figure 6C:
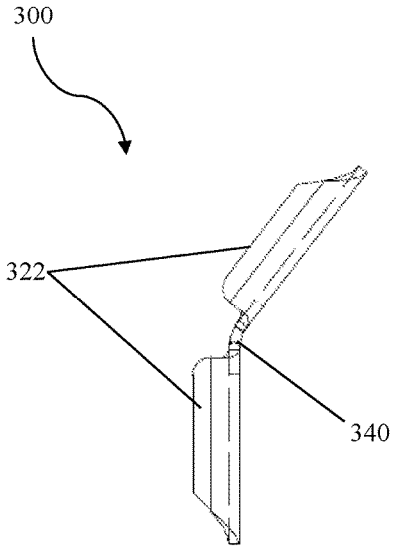
FIG. 6C is a side view of the cam lock of FIG. 6A.
Figure 6D:
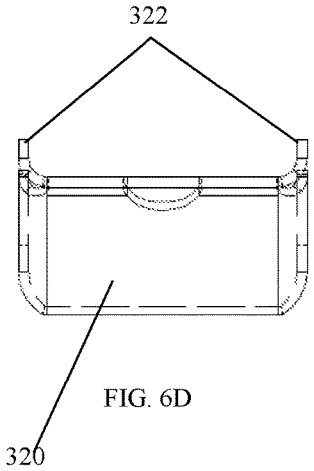
FIG. 6D is a front view of the cam lock of FIG. 6A.
Figure 6E:
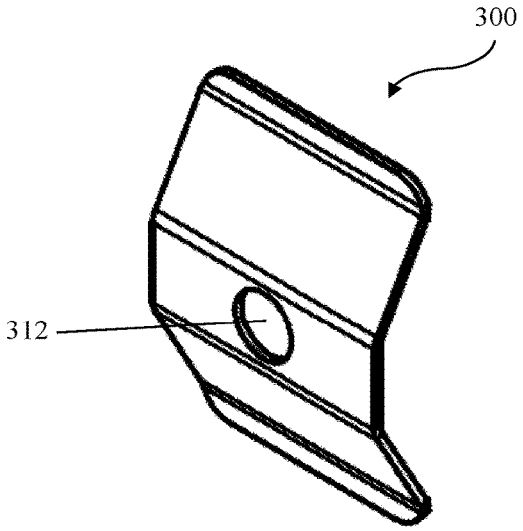
FIG. 6E is a perspective view of one embodiment of a cam lock.
Figure 6F:
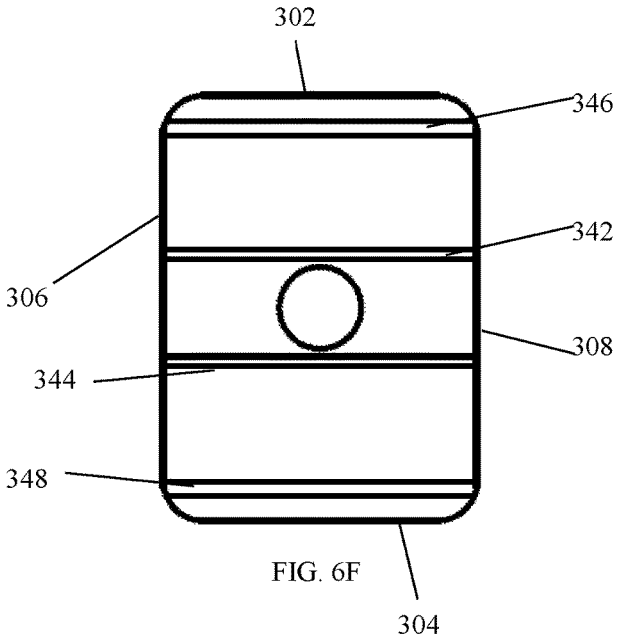
FIG. 6F is a top view of the cam lock of FIG. 6E.
Figure 6G:
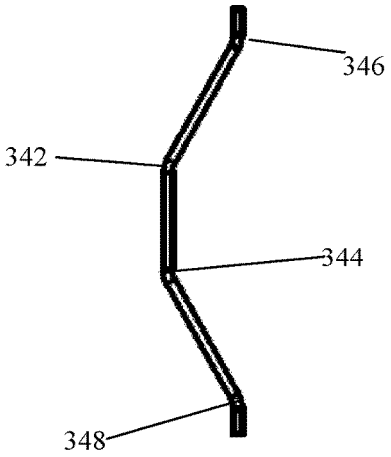
FIG. 6G is a side view of the cam lock of FIG. 6E.

FIG. 6A depicts an exemplary embodiment of the cam lock 300 according to the present disclosure. The cam lock 300 may be constructed of a single sheet of material having a height and a width. The height may be measured from a first side 302 to a second side 304, which may be substantially parallel to the first side 302. The width may be measured from a first edge 306 to a second edge 308, which may be substantially parallel to the second edge 308.

In one embodiment, the cam lock 300 includes a second aperture 312, which is adapted to allow the fastener 400 to pass through the cam lock 300. In one embodiment, the second aperture 312 is substantially centered with regard to the height of the cam lock 300. In another embodiment, the second aperture 312 is closer to the first side 302 than the second side 304. Conversely, the second aperture 312 may be closer to the second side 304 than the first side 302. The interior surface defining the second aperture 312 may be adapted to engage the fastener 400. For example, the interior surface may be threaded.

In another embodiment, the cam lock 300 is comprised of a body 320 with flanges 322 extending out from the body 320. In one embodiment, the flange 322 may project from any of the first side 302, second side 304, first edge 306, or second edge 308. The flange 322 may also project in a direction substantially perpendicular to the plane of the body 320. Conversely, the flange 322 may be adapted to engage with the extruded tracks of the trim pieces. For example, in such an embodiment, the body 320 of the cam lock 300 may include a substantially planar (e.g., flat) section with flanges 322 that extend out at an angle from the body 320.

In a further embodiment any of the first side 302, second side 304, first edge 306, or second edge 308 may be tapered, sharp, or serrated. In another embodiment, the flanges 322 may be tapered, sharp, or serrated. In a further embodiment, the flanges 322 may be curved. The flanges 322 may also be adapted to prevent the rotation of the cam lock 300 while tightening the fastener 400. Such rotation may be prevented by the flange 322 of the cam lock 300 contacting either the flange 222 of the base plate 200 or the protuberance 230.

In one embodiment, the cam lock 300 includes a bend line 340, which is adapted to allow the cam lock 300 to bend so that its height is less than the height of the trim piece track. The bend line 340 is adapted to allows the cam lock 300 to be flattened when a fastener 400 applies a downward force onto it. Such flattening permits the cam lock 300 to engage with or wedge into the trim piece track thereby locking the trim piece and splice plate 100 in place. In one embodiment, the second aperture 312 is substantially centered with respect to the height of the cam lock 300. In another embodiment, the second aperture 312 is closer to the first side 302 than the second side 304. Conversely, the second aperture 312 may be closer to the second side 304 than the first side 302. The interior surface defining the second aperture 312 may be adapted to engage the fastener 400. For example, the interior surface defining the second aperture 312 may be threaded.

In certain embodiments the cam lock 300 includes two or more bend lines 340 running substantially parallel to the first side 302 and/or the second side 304. In such embodiments, the a first bend line 342 may be about the same distance from the first side 302 that a second bend line 344 is from the second side 304. In other embodiments, the cam lock 300 includes four or more bend lines 340. In such embodiments, the a third bend line 346 may be about the same distance from the first side 302 that a fourth bend line 348 is from the second side 304. In certain embodiments, the cam lock 300 is bent in different directions at the first and second bend lines 342 and 344 than it is at the third and fourth bend lines 346 and 348, which may define a chicane.

In another embodiment, the height of the cam lock 300, when laid flat, is about the same as the height of the base plate 200. Conversely, the height of the cam lock 300, when laid flat, may be about 85% to about 95% of the height of the base plate 200.

In a further embodiment, the splice plate 100 includes two or more cam locks 300. In one embodiment, one cam lock 300 is located a distance from the first side 202 about equal to the distance as a second cam lock 300 is located from the second side 204. In another embodiment, one cam lock 300 may be closer to the first side 202 than the second cam lock is to the second side 204. In another embodiment, one cam lock 300 may be farther from the first side 202 than the second cam lock 300 is from the second side 204.

Angles of Cam Lock and Base Plate

In certain embodiments, the base plate 200 and the cam lock 300 each contain a bend line 242 and 342. The bend line 242 of the base plate 200 forms a first obtuse angle 250. The bend line 342 of the cam lock 300 forms a second obtuse angle 350. In such embodiments, the first obtuse angle 250 may be greater, less than or equal to the second obtuse angle 350. In certain embodiments the first obtuse angle 250 and second obtuse angle 350 are configured to permit a space to form between the base plate 200 and the cam lock 300 when the cam lock 300 is stacked on top of the base plate 200.

In certain embodiments, the base plate 200 and the cam lock 300 each include two bend lines 242, 244, 342, and 344. The bend lines 242, 244 of the base plate 200 form a first obtuse angle 250. The bend lines 342, 344 of the cam lock 300 form a second obtuse angle 350. In such embodiments, the first obtuse angle 250 is greater than the second obtuse angle 350. Such embodiments may permit a space to form between the base plate 200 and the cam lock 300 when the cam lock 300 is stacked on top of the base plate 200.

In certain embodiments, the first angle 250 may be greater than about 120 degrees whereas the second angle 350 may be about 120 degrees or less. In other embodiments, the first angle 250 may be greater than about 140 degrees whereas the second angle 350 may be 140 degrees or less. Furthermore, in such configurations, the fastening element of the fastener (e.g., the threads of a screw) may have a height that is greater than the sum of the first thickness, the second thickness, and the distance.

In certain embodiments the difference between the first obtuse angle 250 and the second obtuse angle 350 is about 3, about 6, about 9, or about 12 degrees.

In certain embodiments, the base plate 200 and the cam lock 300 each include two bend lines 242, 244, 342, and 344. The bend lines 242, 244 of the base plate 200 form a first obtuse angle. The bend lines 342, 344 of the cam lock 300 form a second acute angle.

Fasteners

The fastener 400 may be any known in the art that may connect the base plate 200 and the cam lock 300. For example, the fastener 400 may be a screw, having a head shape that may be full-bearing, washer-faced, double chamfered, square, slotted-hexagon, countersunk, raised-countersunk, round, pan, cheese, raised-cheese (fillister), mushroom (truss), hi-torque, phillips countersunk, phillips raised countersunk, phillips round-pan, phillips round, countersunk hexagon socket, button hexagon socket, flat or cap hexagon socket, or knurled. In certain embodiments the fastener 400 may be a thumb screw. In other embodiments, the interior surface of the projection 210 may be threaded and the fastener may include a threaded stud attached to a nut of any type, including wing nuts.

In one embodiment the height of the fastener 400 is less than or equal to the sum of the thickness of the cam lock 300 and the distance of the projection 210. In other embodiments, the height of the fastener 400 is greater than the sum of the thickness of the cam lock 300 and the distance of the projection 210. For example, the height of the fastener may be about 0.030" to about 0.080" greater than the sum of the thickness of the cam lock 300 and the distance of the projection 210.

Splice Plate Manufacture

Certain embodiments of the disclosed clip may be manufactured via a progressive stamping die. Other embodiments may be manufactured in a turret press. Still other embodiments may be manufactured via a combination of laser cutting for blanking and break press for forming.

Splice Plate Materials

It will be understood that the splice plate 100 may be constructed from any bendable material such as metals, polymers, or carbon fiber. In one embodiment, the splice plate 100 is manufactured from metal. In another embodiment, the base plate 200 or cam lock 300 is manufactured from a metal that is harder than aluminum. During such manufacture, the cam locks 300 may be heat treated. Such heat treatment may include annealing. Such heat treatment may assist the cam locks 300 to revert to their uninstalled configuration, which may assist during any disassembly of the trim installed using the described splice plates 100.

Incorporation into a Perimeter Trim System Framework

The disclosed splice plate 100 may be incorporated into a perimeter trim system framework. In one embodiment, the splice plate 100 is proportional so that its base plate 200 fits in the grooves of the trim strip with sufficient vertical and horizontal clearance to enable it to slide freely along a straight length of the trim strip. The thickness of the sheet of material forming the base plate 200 is also less than the horizontal width of the grooves.

The splice plate 100 is installed on a trim strip by sliding it into the track from one end of the trim strip. The splice plate 100 may be slid entirely into one trim strip and then pulled back while it is guided into an abutting trim strip end. Alternatively, approximately half the length of the splice plate 100 is slid into one end of a trim strip and the remaining portion is inserted into the other trim strip end to be joined.

Initially, the height of the cam lock 300 is somewhat less than the grooves of the trim strip. The splice plate 100 is locked in place on a trim strip by tightening the fastener 400, for example a screw. When the screw is turned into the hole the cam lock 300 pushed down, thereby flattening the cam lock 300 and increasing its height. The fastener 400, in flattening the cam lock 300, results in the track of the trim strip being forcibly locked or wedged. The splice plate 100 may thus precisely align the appearance or front faces of the abutted trim strips.

Although illustrated and described above with reference to certain specific embodiments and examples, the present invention is nevertheless not intended to be limited to the details shown. Rather, various modifications may be made in the details within the scope and range of equivalents of the claims and without departing from the spirit of the invention. It is expressly intended, for example, that all ranges broadly recited in this document include within their scope all narrower ranges which fall within the broader ranges. It is also expressly intended that the steps of the methods of using the various devices disclosed above are not restricted to any particular order.

What is claimed is:

1. A splice plate for joining and aligning trim strips, the splice plate comprising:

a base plate, including:

a sheet of material having a first base plate side and a second base plate side defining a base plate height a first base plate edge and a second base plate edge defining a base plate width, the base plate height and base plate width defining a base plate plane, a first thickness, a projection defining a first aperture and projecting a distance from the base plate in a direction substantially perpendicular to the base plate plane, wherein the projection includes an inner surface configured to engage a fastener, and a first base plate bend line and a second base plate bend line wherein the first base plate bend line is about the same distance from the first side that the second bend line is from the second side and wherein the first base plate bend line and second base plate bend line define a first obtuse angle;

a cam lock, including:

a sheet of material having a first side cam lock and a second cam lock side defining a cam lock height, a second thickness, a second aperture that includes an inner surface configured to engage the fastener, and a first cam lock bend line and a second cam lock bend line wherein the first cam lock bend line and the second cam lock bend line define a second obtuse angle wherein the first obtuse angle is greater than the second obtuse angle; and the fastener passing through the first aperture and the second aperture thereby connecting the base plate and the cam lock.

2. The splice plate of claim 1, further comprising two or more projections and two or more cam locks.

3. The splice plate of claim 1, wherein the first base plate side or second base plate side is tapered, sharp, or serrated.

4. The splice plate of claim 1, wherein the first cam lock side or second cam lock side is tapered, sharp, or serrated.

5. The splice plate of claim 1, wherein the fastener is a screw, having a head shape that is full-bearing, washer-faced, double chamfered, square, slotted-hexagon, countersunk, raised-countersunk, round, pan, cheese, raised-cheese (fillister), mushroom (truss), hi-torque, phillips countersunk, phillips raised countersunk, phillips round-pan, phillips round, countersunk hexagon socket, button hexagon socket, flat or cap hexagon socket, or knurled.

6. The splice plate of claim 1, wherein the cam lock material is harder than aluminum.

7. The splice plate of claim 1, further comprising a flange extending out from the first base plate edge or the second base plate in the direction of the projection.

8. The splice plate of claim 7, wherein the base plate width has a center, and the flange is farther from the center of the width than the cam lock.

9. The splice plate of claim 1, wherein the cam lock further comprises a first cam lock edge and a second cam lock edge defining a cam lock width, and a flange extending out from either the first cam lock edge or the second cam lock edge in a direction opposite the second obtuse angle.

10. The splice plate of claim 9, wherein the cam lock includes flanges extending out from both the first cam lock edge and second can lock edge in the direction opposite the second obtuse angle.

11. The splice plate of claim 1, wherein the base plate further comprises a weak point.

12. The splice plate of claim 11, wherein the base plate further comprises two or more weak points aligned along the base plate height.

13. The splice plate of claim 11, wherein the weak point is an aperture, notch, or cutout.

14. The splice plate of claim 1, wherein the base plate further comprises a protuberance projecting in a direction substantially perpendicular to the plane of the base plate.

15. The splice plate of claim 14, wherein the base plate width has a center the protuberance is closer to the center of the width than the cam lock.

16. The splice plate of claim 14, wherein the protuberance is a triangle, square, cylinder, circle, oval, or rectangle.

17. The splice plate of claim 14, further comprising two or more protuberances.

* * * * *